US006768069B1

(12) United States Patent
Su

(10) Patent No.: US 6,768,069 B1
(45) Date of Patent: Jul. 27, 2004

(54) MICRO SWITCH

(75) Inventor: Jian-Hao Su, Hsin-Tien (TW)

(73) Assignee: Shin Jiuh Corp., Hsin-Tien (TW)

( * ) Notice: Subject to any disclaimer, the term of this patent is extended or adjusted under 35 U.S.C. 154(b) by 0 days.

(21) Appl. No.: 10/408,453

(22) Filed: Apr. 8, 2003

(51) Int. Cl.[7] ..... H01H 13/28; H01H 13/52; H01H 71/16

(52) U.S. Cl. ..... 200/276.1; 200/61.82; 200/534; 337/66

(58) Field of Search ..... 337/66, 56, 20, 337/37, 52, 53, 55, 59, 112, 113, 348; 200/61.62–61.83, 276, 276.1, 520–535

(56) References Cited

U.S. PATENT DOCUMENTS

| | | | | | |
|---|---|---|---|---|---|
| 3,410,975 | A | * | 11/1968 | Voland | 200/276.1 |
| 3,944,768 | A | * | 3/1976 | Aryamane et al. | 200/453 |
| 4,015,094 | A | * | 3/1977 | Gavagan et al. | 200/61.58 B |
| 4,072,841 | A | * | 2/1978 | Corfield | 200/332 |
| 4,092,503 | A | * | 5/1978 | Raeder | 200/5 A |
| 4,169,974 | A | * | 10/1979 | Peers-Trevarton | 200/276 |
| 4,488,018 | A | * | 12/1984 | Hayashida | 200/6 R |
| 4,684,775 | A | * | 8/1987 | Oba | 200/276.1 |
| 4,698,465 | A | * | 10/1987 | Oba | 200/16 F |
| 4,831,253 | A | * | 5/1989 | Omura et al. | 250/229 |
| 4,937,407 | A | * | 6/1990 | Osika | 200/302.3 |
| 5,488,032 | A | * | 1/1996 | Dower et al. | 200/534 |
| 5,717,177 | A | * | 2/1998 | Tsai et al. | 200/16 R |
| 5,912,445 | A | * | 6/1999 | Takedomi | 200/276.1 |
| 5,913,415 | A | * | 6/1999 | Kishi et al. | 200/456 |

FOREIGN PATENT DOCUMENTS

| | | | | | |
|---|---|---|---|---|---|
| EP | 1261002 | A1 | * | 11/2002 | H01H/21/28 |
| JP | 07147115 | A | * | 6/1995 | H01H/13/52 |
| JP | 10188726 | A | * | 7/1998 | H01H/13/28 |
| JP | 2000164077 | A | * | 6/2000 | H01H/23/30 |
| JP | 2000306448 | A | * | 11/2000 | H01H/3/04 |
| TW | 345673 | | | 11/1998 | |
| TW | 477995 | | | 3/2002 | |
| TW | 492027 | | | 6/2002 | |
| TW | 493189 | | | 7/2002 | |
| TW | 517254 | | | 1/2003 | |
| WO | WO 200237517 | A1 | * | 5/2002 | H01H/13/52 |

* cited by examiner

*Primary Examiner*—Anatoly Vortman
(74) *Attorney, Agent, or Firm*—Birch, Stewart, Kolasch & Birch, LLP

(57) ABSTRACT

A micro switch is disclosed in the invention, which can be assembled and manufactured easily. Through a conjoining portion formed between a first conductive portion and a second conductive portion of resilient element that are used for switching on/off the electrical contact, and through a positioning portion that is for conjoining to the resilient element and is provided in the concave slot of the pushbutton corresponding to the conjoining portion, the first conductive portion of resilient element can then often keep in a contact manner with the first contact portion of first conductive terminal extending to the acceptance room. In addition, a pressing portion corresponding to the pushbutton will apply downward force on the second conductive portion so that the second conductive portion will move downwards to touch the second contact portion of second conductive terminal extending to the acceptance room. Thus, a micro switch that is easy to be assembled is then formed.

6 Claims, 5 Drawing Sheets

MICRO SWITCH

FIELD OF THE INVENTION

The invention relates to a micro switch and, more particularly, to a micro switch having bi-directional operation to switch on/off the electrical contact point.

BACKGROUND OF THE INVENTION

A conventional small-sized micro switch with bi-directional operation for switching on/off the electrical contact point utilizes terminals that have first and second conductive portions protruding from the sidewall opposite to the acceptance room. When in a free state, the first conductive portion is not in contact with the first movable contact portion of the coil spring. Conversely, when the switch is activated, the operation portion of pushbutton will be pressed down, which in turn will cause the coil spring to move, making a contact with the first movable contact portion. Unlike the first conductive portion, the second conductive portion often contacts the second movable contact portion of coil spring. Therefore, in order to prevent the pushbutton from shifting or detaching caused by pushing-up resilience generated by the coil spring when the pushbutton is trying to get back to its original free state after a switching on/off action, the pushbutton has to contain a first brake element that is extending from the location of pivot point axis so that the pushbutton can perform positioning for itself at the location where the pivot point axis departs. On the other hand, the main body of micro switch has a second brake element formed at the main body thereon. The second brake element will touch the first brake element of pushbutton when the first brake element receives force from the coil spring and begins to rotate relative to the shut direction. After that, positioning a free-state pushbutton can then be performed.

However, regarding to the above-mentioned positioning method, since the volume of micro switch is very small, it is not an ideal method to form another tiny brake element because the brake element cannot provide good strength, neither can it be manufactured with good degree of precision. Therefore, the yielding of product will not be good enough if the method is applied, and the cost of assembling labor will also increase since product precision control cannot be well performed, either.

Moreover, if product precision is not good enough, or if the coil spring becomes fatigued because the downward-pressing process is too long, the often-in-contact manner between the second conductive portion and the second movable contact portion of the coil spring will then fail to be kept. Consequently, the switching-on-for-conducting made by the electrical contact point cannot be generated when the pushbutton is pressed down; that is, the small-sized switch has lost its function of conducting-at-pressing. In other words, the lifespan of micro switch is shortened.

SUMMARY OF THE INVENTION

To solve the above problems, the object of the invention is to provide a micro switch that is easy to be assembled and manufactured without taking the trouble to change volume for the existing product as well as to go through complicated manufacturing process and product precision control. Through a conjoining portion formed between a first conductive portion and a second conductive portion of resilient element that are used for switching on/off the electrical contact point, and through a positioning portion that is for conjoining to the resilient element and is provided in the concave slot of the pushbutton corresponding to the conjoining portion, the first conductive portion of resilient element can then often keep in a contact manner with the first contact portion of first conductive terminal extending to the acceptance room. In addition, the second conductive portion can move downwards to contact the second contact portion of second conductive terminal extending to the acceptance room because the second conductive portion is pressed by a pressing portion provided corresponding to the pushbutton. Therefore, a micro switch easy to be assembled is formed.

DESCRIPTION OF THE PREFERRED EMBODIMENTS

Figure 2A:
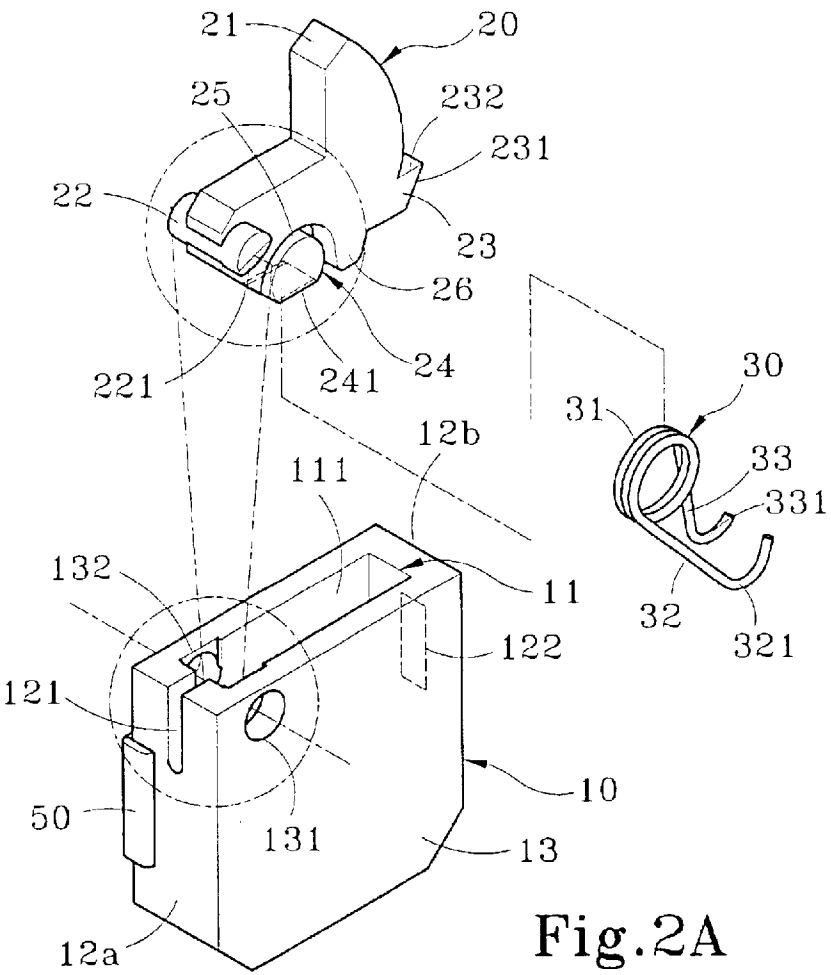
FIG. 2A is a schematic diagram showing an exploded view of the invention.
Figure 1:
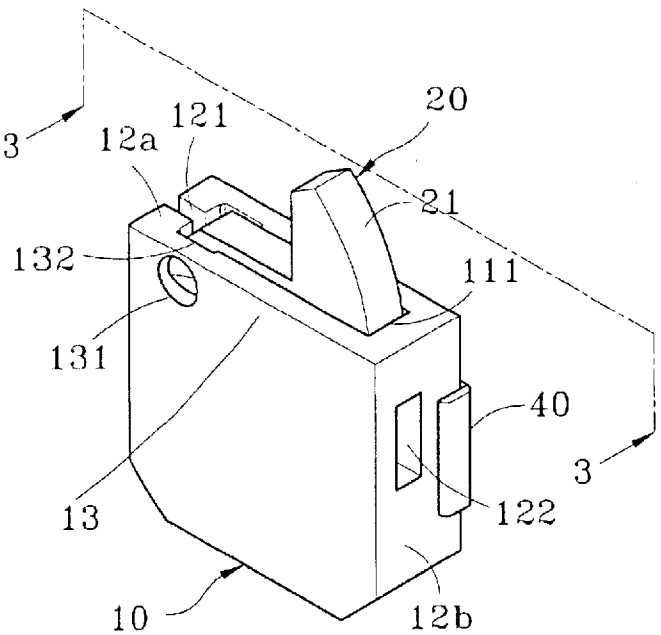
FIG. 1 is a perspective schematic diagram showing an external view of the invention.
Figure 2C:
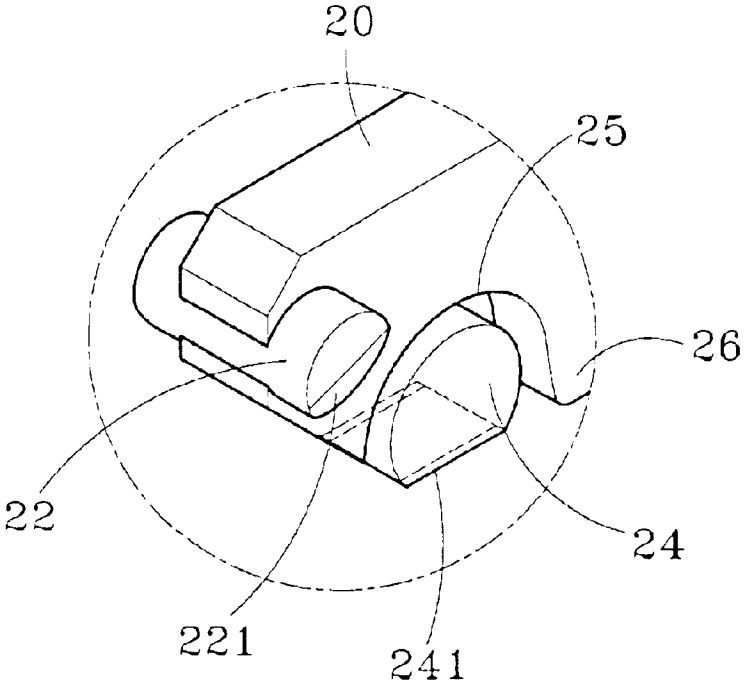
FIGS. 2B and 2C are schematic diagrams showing an enlarged view of partial structure of the invention.
Figure 2B:
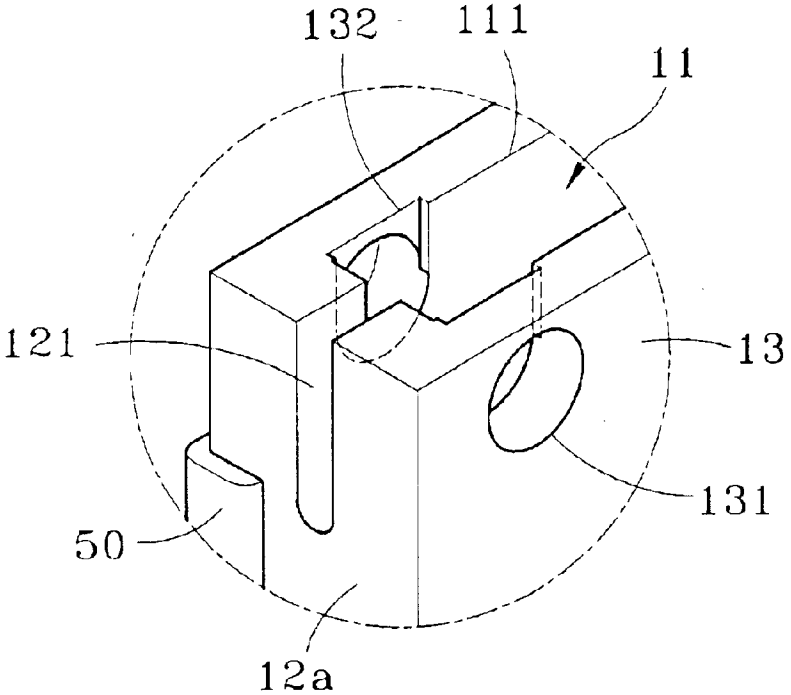

The technical contents of the invention will be described below with reference to the accompanied drawings.

FIGS. 1 and 2A–2C are schematic diagrams showing the external view and exploded view of the invention respectively. Referring to the FIGS., the invention first includes a main body 10, wherein an acceptance room 11 is formed internally therein. Second, a first conductive terminal 40 and a second conductive terminal 50 are provided separately at each of the two side walls 12*a* and 12*b* of main body 10. Third, a pivot point 22 is provided in the acceptance room 11, wherein the pivot point 22 can be freely rotating to support the pushbutton 20 of main body 10. Fourth, a force-receiving portion 21 of pushbutton 20 is located at the lower side of pushbutton 20 to provide resilience capable of pushing up the pushbutton 20 to be protruded from the main body 10 to form the pushbutton 20. Fifth, a resilient element 30 of first and second conductive portions 32 and 33 contacts first and second conductive terminals 40 and 50 separately. Sixth, a round hole 131 is provided at two sides 13 of main body 10 corresponding to the pivot point 22 of pushbutton 20, and a place-in slot 132 is provided extending from the round hole 131 to the opening end 111 of the acceptance room 11. Seventh, a gap 121 is provided on the sidewall 12*a* of main body 10 adjacent to the round hole 131 and is extending to the opening end 111 of the acceptance room 11. Finally, a guiding slanting face 221 is formed at the lower edge of pivot point 22 of pushbutton 20; therefore, through flexible force formed by the gap 121 and through the guiding slanting face 221 that makes it easy for the pivot point 22 to be conjoined to the round hole 131, a micro switch having a longer activation interval is then formed.

Figure 4:
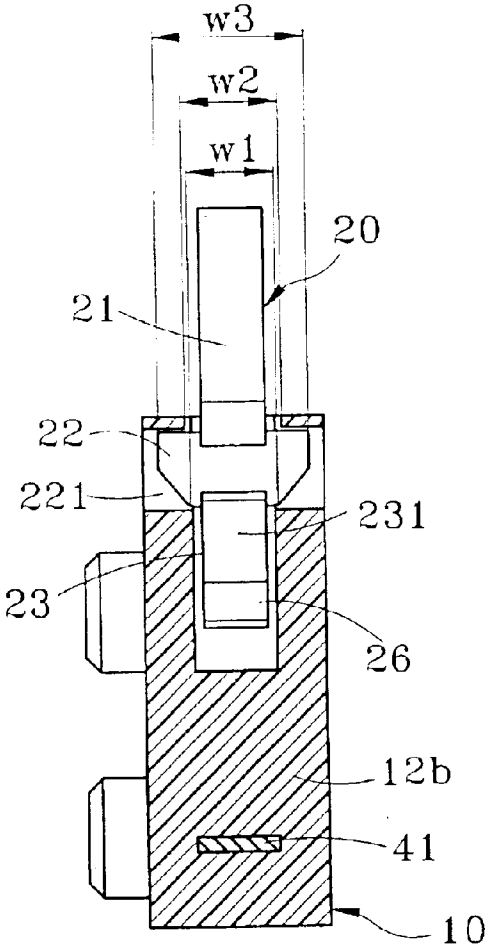
FIG. 4 is a schematic diagram showing sectional view of FIG. 3 cutting along the line 4—4.
Figure 3:
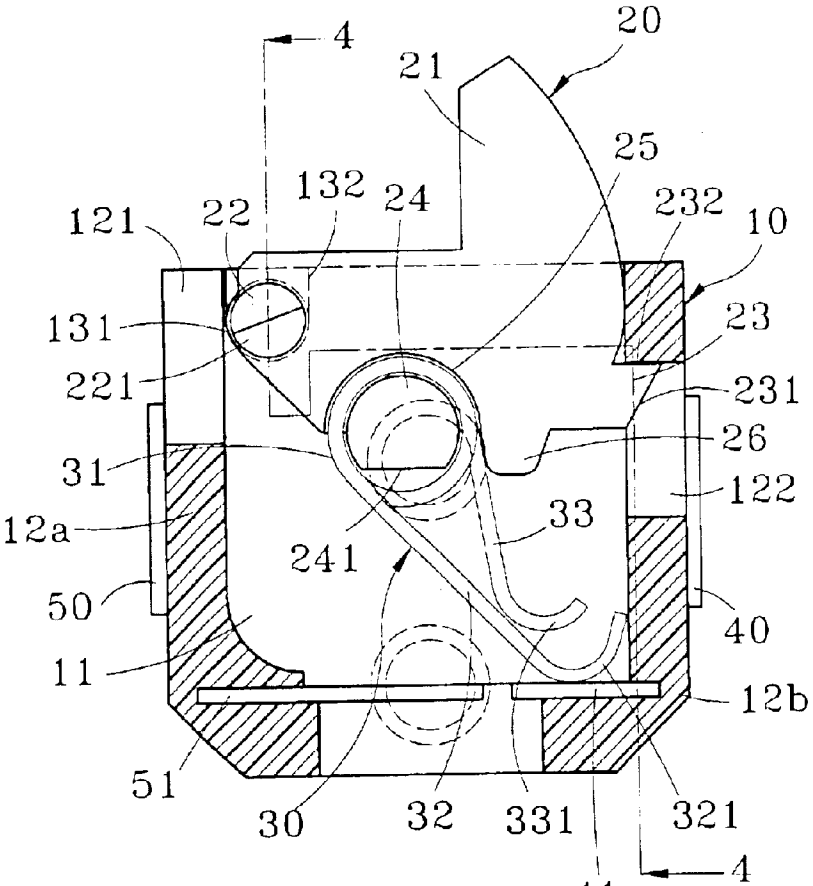
FIG. 3 is a schematic diagram showing sectional view of FIG. 1 cutting along the line 3—3.

Also, referring to FIGS. 3 and 4, the resilient element 30 of the invention is a coil spring, and a conjoining portion 31 is formed between the first conductive portion 32 and the second conductive portion 33 of resilient element 30. Besides, a positioning portion 24 used for conjoining to the resilient element 30 is provided in the concave slot 25 of the pushbutton 20 corresponding to the conjoining portion 31, wherein a straight-lined confining edge 241 is provided at the lower part of positioning portion 24, which makes the positioning portion 24 a non-circle shaped. Therefore, to prevent the pushbutton 20 from shaking or shifting, the first thing to do is to place the conjoining portion 31 of resilient element 30 into the concave slot 25 of pushbutton 20, and then employ the non-circled design of positioning portion 24 so that the conjoining portion 31 will not be shifted due to rotation generated by press-down force. In addition to that, the assembling method of pushbutton 20 is also designed to enhance its positioning effect. When assembling pushbutton 20 of the invention, the width of its pivot point 22 is defined as w2, the width of guiding slanting face 221 is defined as w1, and the width of place-in slot 132 is defined as w3, wherein the relation among them is w2>w3>w1. Thus, the design of invention is first to enter the place-in slot 132 through the guiding slanting face 221, wherein the place-in slot 132 of opening end 111 is flexible and capable of stretching due to the presence of gap 121. Besides, the guiding slanting face 221 has a certain slope allowing the pushbutton 20 to be moved downwards to the pivot point 22 and then enter the round hole 131 without assistance from any tools as well as without destroying configuration of main body 10. In addition, after the pivot point 22 has entered the round hole 131, the pushbutton 20 will not be easily detached because the width w2 of pivot point 22 is larger than the width w3 of place-in slot 132. Moreover, in order to reinforce the positioning effect for the pushbutton 20, a confining portion 122 is provided at the other sidewall 12*b* of main body 10 opposite to the gap 121. Also, a top-ending portion 23 is provided extending from the main body 10 corresponding to the confining portion 122, wherein the top-ending portion 23 includes a place-in face 231 and a press-top face 232, which will all move downwards when the pushbutton 20 is moving downward. Additionally, the place-in face 231 also has a design of slanting angle. After the top-ending portion 23 has entered the confining portion 122, the upper wall of confining portion 122 will block the press-top face 232 even though the pushbutton 20 is in a free state. Therefore, the positioning effect of pushbutton 20 can be enhanced.

Figure 5B:
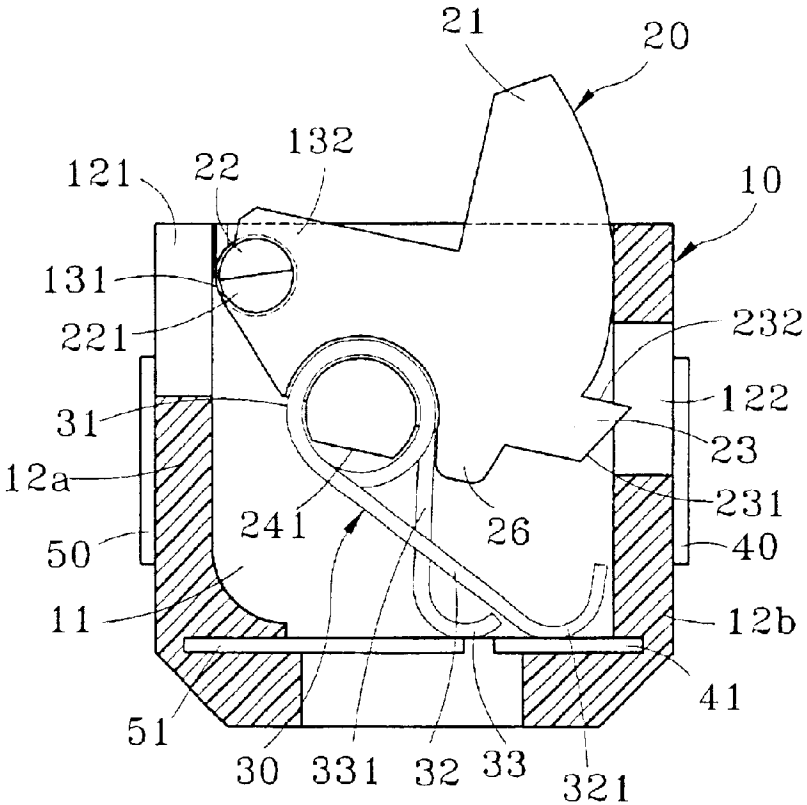
FIGS. 5A, 5B, and 5C are schematic diagrams showing activations of the invention when it is receiving force from left and vertical directions.
Figure 5A:
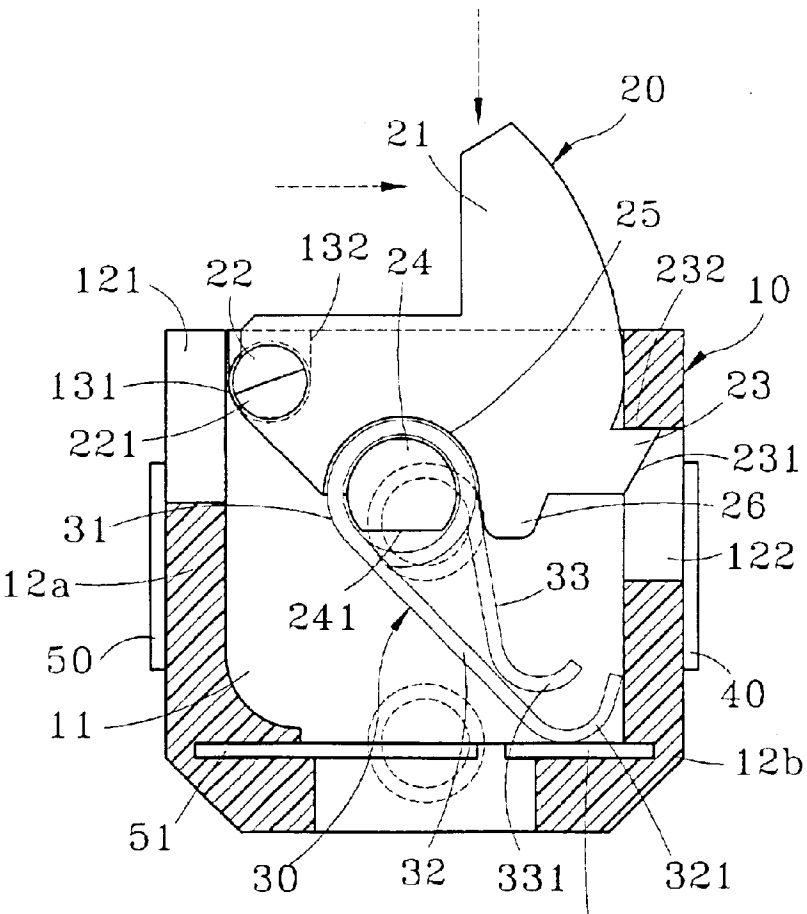

Furthermore, FIGS. 5B and 6B illustrate the on/off status of electrical contact point when it is in use after assembly. In the invention, the first conductive portion 32 of resilient element 30 often keeps in a contact manner with the first contact portion 41 of first conductive terminal 40 that is extending to the acceptance room 11. Then, a pressing portion 26 corresponding to the pushbutton 20 will apply downward force on the second conductive portion 33 so that the second conductive portion 33 will move downwards to touch the second contact portion 51 of second conductive terminal 50 that is extending to the acceptance room 11 in order for the electrical contact point to keep on conducting. In addition, to ensure that the first and second conductive portions 32 and 33 of resilient element 30 and the first and second conductive terminals 40 and 50 can all be in a contact after the pushbutton 20 is pressed down, a first get-conduction terminal 321 and a second get-conduction terminal 331 provided at the ends of first conductive portion 32 and second conductive portion 33 of the resilient element 30 respectively are bent so that there will not be pointed-end contact only; instead, a line-faced contact will be used to ensure that the electrical contact point will provide conduction when in contact.

Figure 5C:
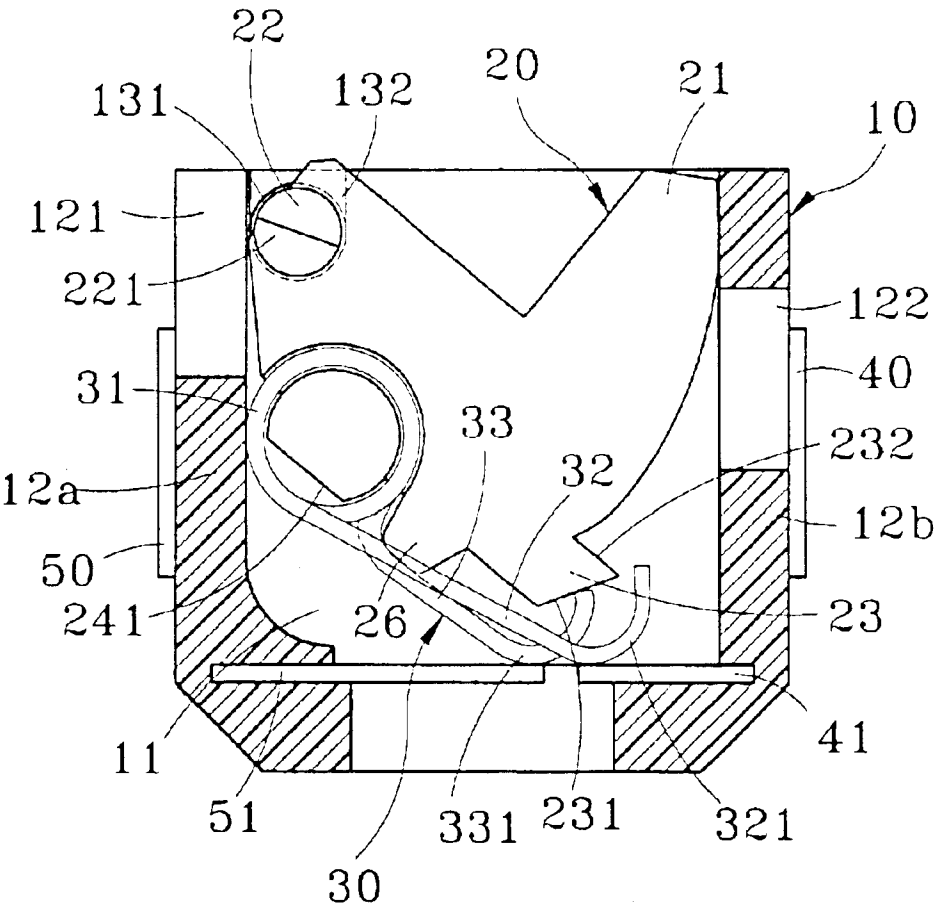

FIGS. 5C and 6C are mainly to disclose that the receiving force of pushbutton 20 has reached the minimum point of activation interval. Comparing FIGS. 5C and 6C to FIG. 3, it is obvious that since the pushbutton 20 can be free from any obstacle and limitation, the pivot point 22 can then rotate freely, allowing the force-receiving portion 21 of pushbutton 20 to enter the acceptance room 11 completely so as to achieve longer activation interval.

Because the pushbutton 20 and the resilient element 30 can be easily placed into the acceptance room 11 to be conjoined to the main body 10 without any tools, it can then be ensured that not only has the structure of the invention been simplified, but the micro switch also will not bring in manufacturing and assembling problems caused by over-diminished volume. Therefore, the micro switch of the invention can actually be assembled and manufactured easily.

What is claimed is:

1. A micro switch, including: first, a main body, wherein an acceptance room is formed therein; second, a first conductive terminal and a second conductive terminal, which are separately provided on the sidewalls of main body; third, a pivot point located inside the acceptance room capable of freely rotating to support a pushbutton on the main body; fourth, a force-receiving portion of pushbutton located at the lower side of pushbutton to provide resilience capable of pushing up the pushbutton protruding from the main body to form the pushbutton; and finally, a resilient element having first and second conductive portions that contact first and second conductive terminals separately; at first and a second contact portions, respectively the features of micro switch are described as below:

a conjoining portion is formed between the first conductive portion and the second conductive portion of resilient element; besides, a positioning portion used for conjoining portion of the resilient element is provided in a concave slot formed on the pushbutton corresponding to the conjoining portion; the first conductive portion of resilient element often contacts the first contact portion of first conductive terminal extending to the acceptance room; in addition, the second conductive portion will move downwards to contact the second contact portion of second conductive terminal extending to the acceptance room because the second conductive portion is pressed down by a pressing portion provided corresponding to the pushbutton.

2. The micro switch as claimed in claim 1, wherein a round hole is provided at two sides of main body corresponding to the pivot point of pushbutton, and a place-in slot is provided extending from the round hole to an opening end of the acceptance room; besides, a gap is provided on the sidewall of the main body adjacent to the round hole, extending to the opening end of the acceptance room; also, a guiding slanting face is formed at the lower edge of pivot point of pushbutton.

3. The micro switch as claimed in claim 2, wherein a confining portion is provided at the other sidewall of main body opposite to the gap; also, a top-ending portion is provided extending from the main body corresponding to the confining portion, wherein the top-ending portion includes a place-in face and a press-top face.

4. The micro switch as claimed in claim 1, wherein a straight-lined confining edge is provided at a lower part of positioning portion, which makes the positioning portion of a non-circled shape.

5. The micro switch as claimed in claim 1, wherein a first get-conduction terminal and a second get-conduction terminal provided separately at the end of first conductive portion and the end of second conductive portion of the resilient element respectively, wherein said first and second get-condition terminals formed as bends.

6. The micro switch as claimed in claim 1, wherein the resilient element is a coil spring.

* * * * *